US006332457B1

(12) United States Patent
Imoehl

(10) Patent No.: US 6,332,457 B1
(45) Date of Patent: Dec. 25, 2001

(54) METHOD OF USING AN INTERNALLY HEATED TIP INJECTOR TO REDUCE HYDROCARBON EMISSIONS DURING COLD-START

(75) Inventor: William James Imoehl, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/316,944

(22) Filed: May 21, 1999

Related U.S. Application Data

(60) Provisional application No. 60/122,162, filed on Feb. 26, 1999.

(51) Int. Cl.[7] ..... F02M 31/00
(52) U.S. Cl. ..... 123/549; 123/557; 123/179.21
(58) Field of Search ..... 123/549, 179.21, 123/557

(56) References Cited

U.S. PATENT DOCUMENTS

| | | | |
|---|---|---|---|
| 3,868,939 | | 3/1975 | Friese et al. . |
| 4,458,655 | | 7/1984 | Oza . |
| 4,760,818 | | 8/1988 | Brooks et al. . |
| 4,898,142 | | 2/1990 | Van Wechem et al. . |
| 5,003,953 | * | 4/1991 | Weglarz et al. ..... 123/478 |
| 5,056,495 | | 10/1991 | Yamashita et al. . |
| 5,218,943 | | 6/1993 | Takeda et al. . |
| 5,349,932 | * | 9/1994 | Boverie et al. ..... 123/399 |
| 5,401,935 | | 3/1995 | Smith et al. . |
| 5,609,297 | | 3/1997 | Gladigow et al. . |
| 5,758,826 | | 6/1998 | Nines . |

OTHER PUBLICATIONS

Hofmann, Klawatsch and Richter; "A Newly Developed Flash–Boiling Fuel–Injection Valve for Improved Cold–Start and Warm–Up," 7. Aachener Kolloquium Fahrzeug–und Motorentechnik 1998, Germany, Oct. 1998, Translation Included.

* cited by examiner

*Primary Examiner*—Marguerite McMahon

(57) ABSTRACT

A method of heating fuel using a heated tip fuel injector includes providing an internal combustion engine having at least one fuel injector, the at least one fuel injector having an internal heater; energizing the engine starter and the internal heater; injecting fuel using closed valve injection; changing the load on the engine and substantially simultaneously switching to open valve injection; and after catalyst light-off, substantially simultaneously switching to closed valve injection.

15 Claims, 17 Drawing Sheets

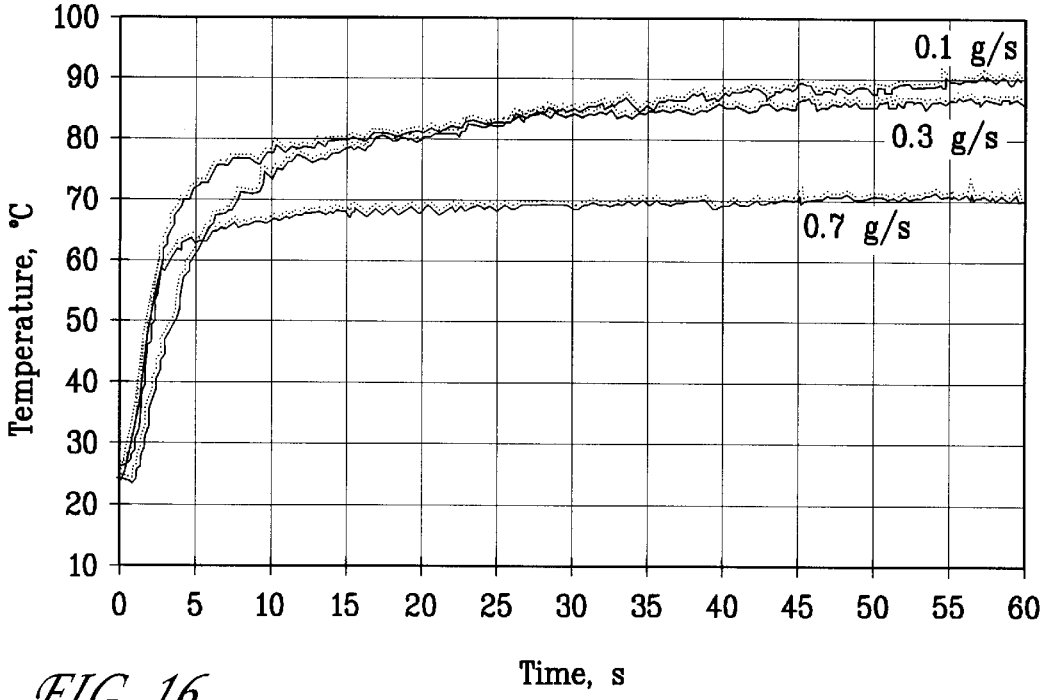
FIG. 16
FIG. 17
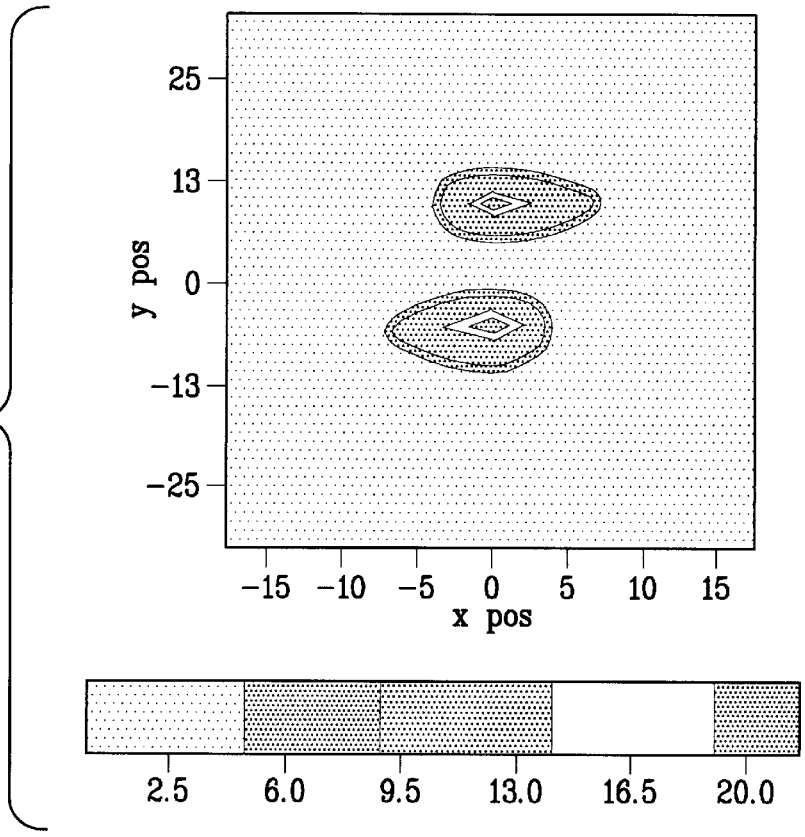

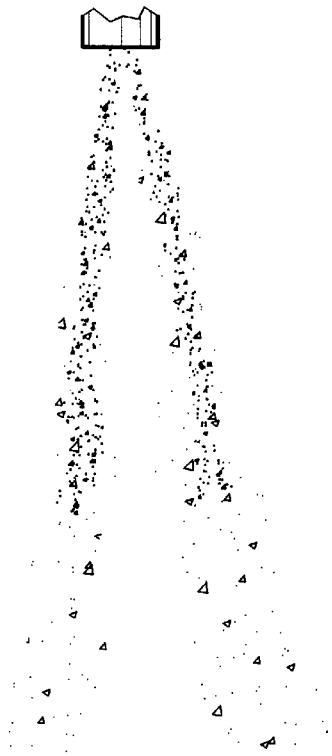
FIG. 18
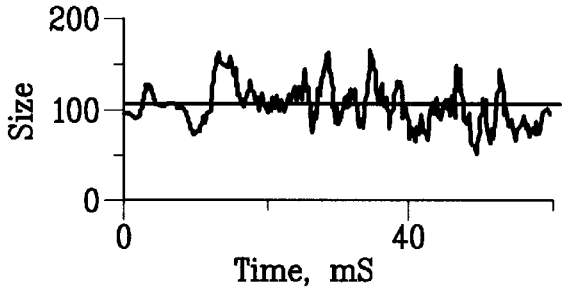
FIG. 19A
FIG. 19B
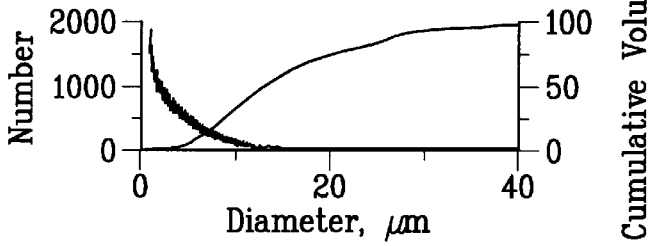

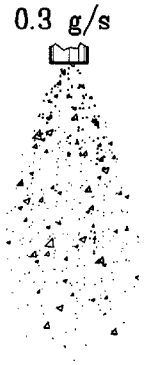
FIG. 20A
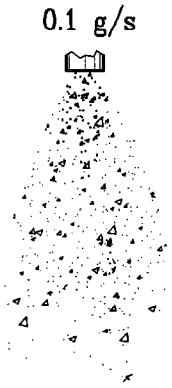
FIG. 20B
FIG. 21A
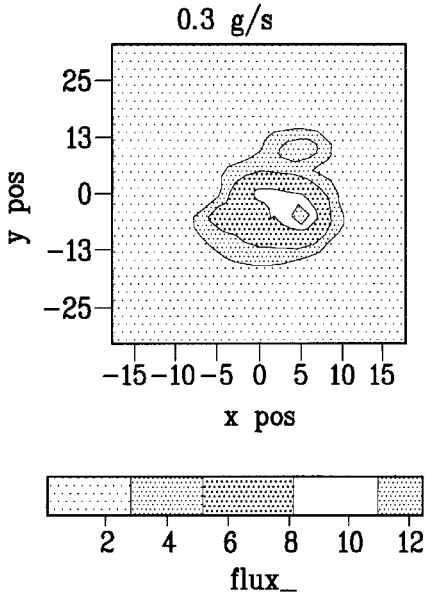
FIG. 21B
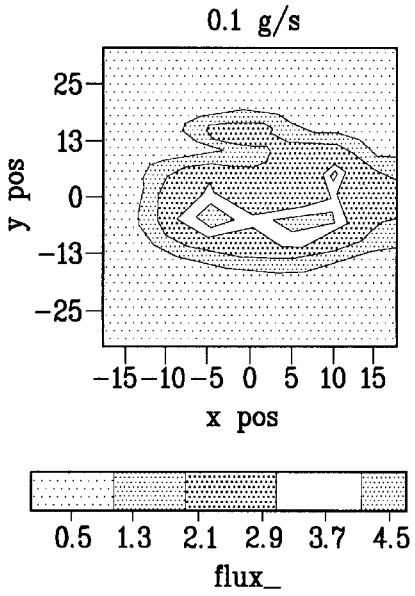

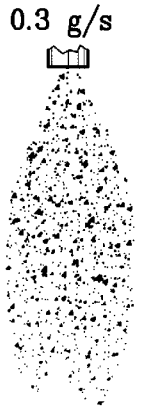
FIG. 22A
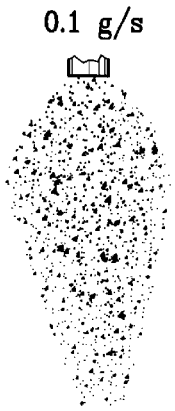
FIG. 22B
FIG. 23A
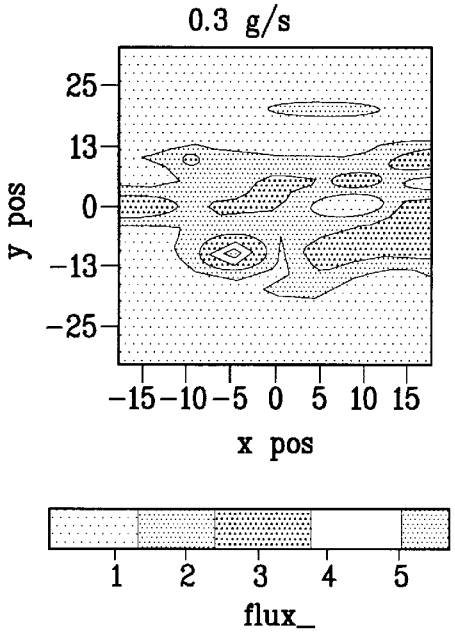
FIG. 23B
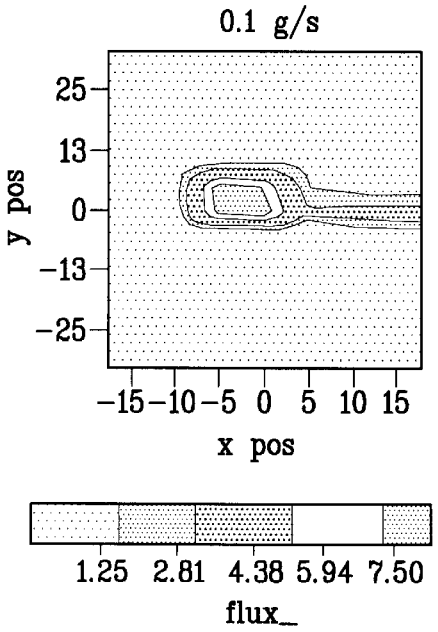

METHOD OF USING AN INTERNALLY HEATED TIP INJECTOR TO REDUCE HYDROCARBON EMISSIONS DURING COLD-START

This application is a provisional of 60/122,162 filed Feb. 26, 1999.

BACKGROUND OF THE INVENTION

The present invention relates in general to heated tip fuel injectors, and, in particular, to a method of using heated tip fuel injectors to reduce hydrocarbon (HC) emissions in internal combustion engines.

Today's standards for low and ultra-low emissions vehicles require increased research and development in unburned HC emissions, particularly in operations such as engine cold starts. In this operating mode, the initial compression strokes ordinarily take place with cold intake valves, and cold port and cylinder walls. Consequently, the fuel evaporation rate is slow even though the overall air/fuel (A/F) mixture is within ignitable limits. These effects become more severe if the ambient temperature drops below 0° C. Also, conventional three-way catalytic converters used for exhaust gas after treatment are ineffective in oxidizing unburned HCs until heated to their "light-off" temperature by the heat transfer from exhaust gases.

The automotive industry is making a strong effort to decrease the catalyst "light-off" time and, thus, decrease HC emissions. A more reasonable approach is to reduce the cold enrichment with a more complete atomized spray because unburned fuel causes these emissions. Several studies reported using technologies such as air-assist injectors, preheated intake ports, or engine blocks to make just such improvements. However, the automotive industry has adopted few of these technologies because of their increased engine complexity or insufficient level of spray atomization.

The level of fuel atomization is sufficient if the spray droplets are small enough to be entrained by the intake air flow. The fuel then can be transported into the cylinder without depositing on the intake port or cylinder wall. An estimated 20 $\mu$m-droplet size is required to avoid spray impingement and follow the air flow, assuming a common intake port geometry and low air speeds.

The present invention enhances spray atomization, especially during cold starts, by heating fuel inside the injector. A high percentage of the fuel immediately vaporizes when the liquid exits the orifice (flash boiling). The energy released in flash boiling breaks up the liquid stream, creating a vapor mixture with droplets smaller than 25 $\mu$m.

Even though the advantages of fuel vaporization by heating are well known, the automotive industry has not adopted several concepts because they are considered impractical. Nevertheless, by heating the fuel inside the fuel injector, the heated tip injector has several advantages. The heater is in direct contact with the fuel, which promotes faster heating. In addition, the heater can be turned off when not needed, allowing the heated tip injector to function as a normal port fuel injector with well-defined targeting.

SUMMARY OF THE INVENTION

It is an object of the present invention to provide a method of using heated tip fuel injectors to reduce HC emissions when cold-starting internal combustion engines.

This and other objects of the invention are achieved by a method of heating fuel using a heated tip fuel injector comprising providing an internal combustion engine having at least one fuel injector, the at least one fuel injector having an internal heater; and substantially simultaneously energizing an engine starter and the internal heater.

Preferably, the method further comprises, after the energizing step, the step of injecting fuel using closed valve injection. Then, after the step of injecting fuel using closed valve injection, the method comprises the step of changing the load on the engine and substantially simultaneously switching to open valve injection. Next, the method comprises the step of catalyst light-off and substantially simultaneously switching to closed valve injection.

In another embodiment, the inventive method of heating fuel using a heated tip fuel injector comprises providing an internal combustion engine having at least one fuel injector, the at least one fuel injector having an internal heater; starting the engine; and then energizing the internal heater.

In yet another embodiment, the inventive method of heating fuel using a heated tip fuel injector comprises providing an internal combustion engine having at least one fuel injector, the at least one fuel injector having an internal heater; energizing the internal heater; and then starting the engine.

Further objects, features and advantages of the invention will become apparent from the following detailed description taken in conjunction with the accompanying drawings.

BRIEF DESCRIPTION OF THE DRAWINGS

FIG. 16 shows temperature curves with a turbulator.

FIG. 17 shows volume flux (%) at 50 mm below the injector tip—split stream, atmospheric pressure.

FIG. 18 shows typical spray—heat off.

FIGS. 19A and 19B show drop size vs. time, number and cumulative volume vs.diameter size, heat off, atmospheric.

FIGS. 20A and 20B show spray at 70 kPa back pressure—heat on.

FIGS. 21A and 21B show an analysis of the flux volume.

FIGS. 22A and 22B show spray at 40 kPa back pressure—heat on.

FIGS. 23A and 23B show volume flux (%) at 40 kPa back pressure.

DETAILED DESCRIPTION OF THE PREFERRED EMBODIMENTS

The present invention is a method of heating fuel using a fuel injector having an internal heater (heated tip fuel injector). Heated tip fuel injectors are known, for example, from U.S. Pat. Nos. 5,758,826; 3,868,939; 4,458,655; and 4,898,142. The aforementioned four U.S. patents are hereby expressly incorporated by reference. The present invention applies the heated tip injector to the cold-starting of an internal combustion engine to optimize fuel atomization and thereby decrease HC emissions.

Figure 1:
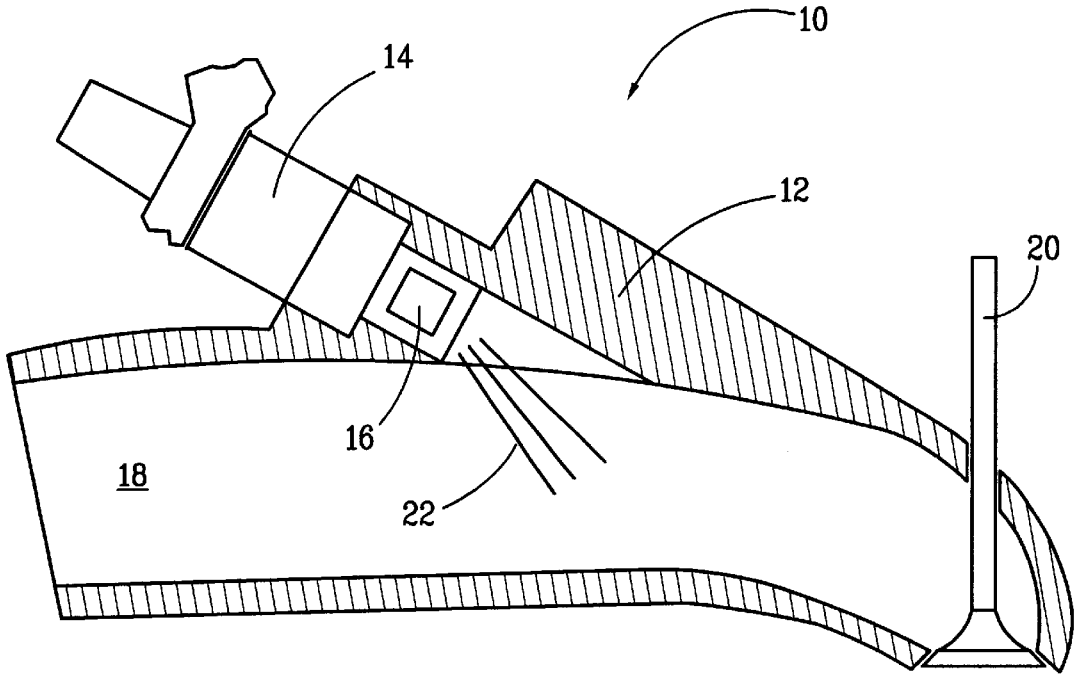
FIG. 1 schematically shows a portion of an internal combustion engine having a fuel injector with an internal heater.

FIG. 1 schematically shows a portion of an internal combustion engine 10 including a head casting 12, an intake port 18, a fuel injector 14 having an internal heater 16, and an intake valve 20. A fuel stream 22 is discharged from the injector 14 into the intake port 18. The present invention is a method of energizing and de-energizing the internal heater 16 so that HC emissions are reduced during cold-start. For the sake of clarity only one injector 14 is shown, however, it should be understood that the invention is applicable to engines with any number of cylinders and fuel injectors.

When a vehicle key is inserted in the ignition switch of a vehicle, the key is rotated first to a "key-on " position wherein electrical power is supplied to the vehicle's electrical system, but the engine starter is not yet energized. In one embodiment of the invention, the internal heater 16 is energized at the "key-on" position. The key is then further rotated to energize the engine starter to start the engine. If the key is inserted in the ignition switch and then rotated quickly through the key-on position to the start position (as is the case most of the time), the internal heater 16 is energized substantially simultaneously with energizing of the engine starter.

On the other hand, if there is some delay in rotating the key from the key-on position to the start position, then the internal heater 16 is energized before the engine starter is energized. Thus, depending on the amount of time the ignition switch is in the key-on position, the internal heater 16 may be energized either before or substantially simultaneously with energizing of the engine starter.

In another embodiment of the invention, the internal heater 16 is not energized until after the engine is started. This embodiment is useful when the load on the battery needs to be minimized, as in cold weather starting, for example.

In all embodiments of the invention, fuel injection begins on a closed intake valve 20. Additionally, the internal heater 16 is always de-energized after catalyst light-off.

If the engine is idled from start to catalyst light-off, then fuel injection is always on a closed intake valve 20. On the other hand, if the load on the engine is changed prior to catalyst light-off, then fuel injection is switched to open valve injection substantially simultaneously with the load change. Then, after catalyst light-off, the fuel injection is switched substantially simultaneously back to closed valve injection.

Figure 2:
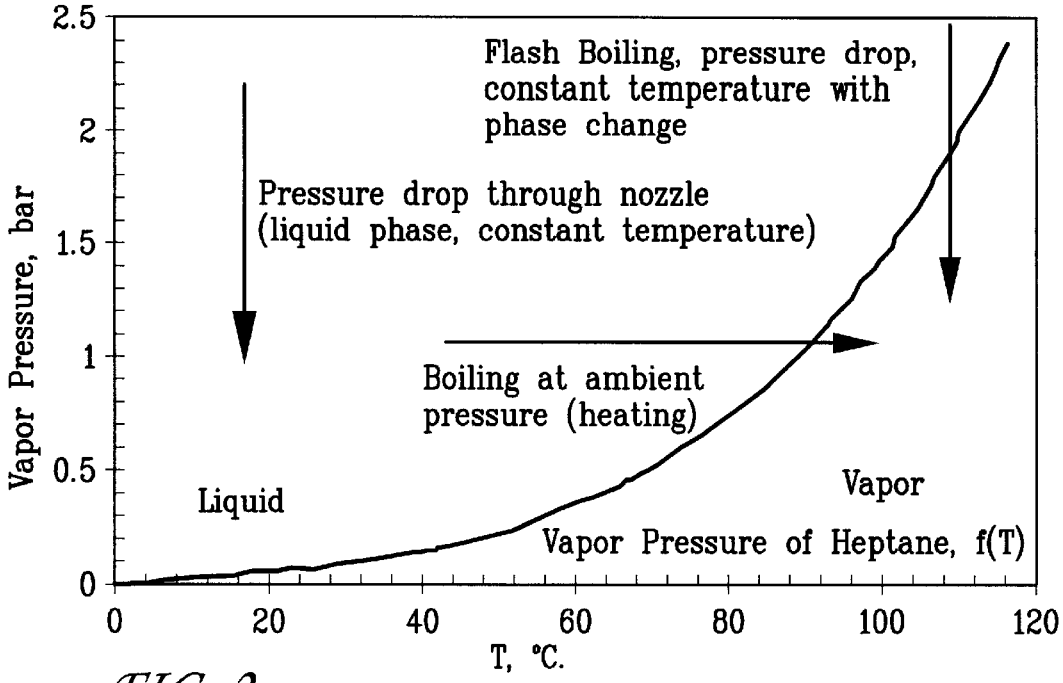
FIG. 2 graphically show boiling, flash boiling and pressure drop in liquid phase.

The present invention is based on enhancing atomization by heating fuel using flash boiling. Liquid boils at a given fuel temperature when the ambient pressure drops below the vapor pressure. Flash boiling occurs when there is a sudden pressure drop, that is, the ambient pressure drops below the vapor pressure of the liquid at approximately constant liquid temperature (see FIG. 2).

The pressure drop for a heated tip injector occurs at the orifice disk, just like most conventional port fuel injectors. The atomization efficiency for a heated tip injector depends on the pressure and temperature in the manifold as well as the pressure and temperature inside the injector.

The heated tip injector functions well only if fuel boiling is avoided inside the injector. Boiling inside the injector causes two significant problems: heat transfer from the heating element to the fuel is significantly reduced and fuel metering is more difficult. Because fuel comprises about 270 different constituents, there is no definite relation between boiling temperature and vapor pressure, such as for single-constituent liquids. Therefore, a vapor curve at atmospheric pressures is given for fuel, which normally ranges between 20 and 200° C. This vapor curve shifts to lower temperatures for vacuum conditions, such as in a manifold (see FIG. 3). In contrast, it shifts to higher temperatures for higher pressures, such as the fuel pressure in the injector (see FIG. 4).

Figure 3:
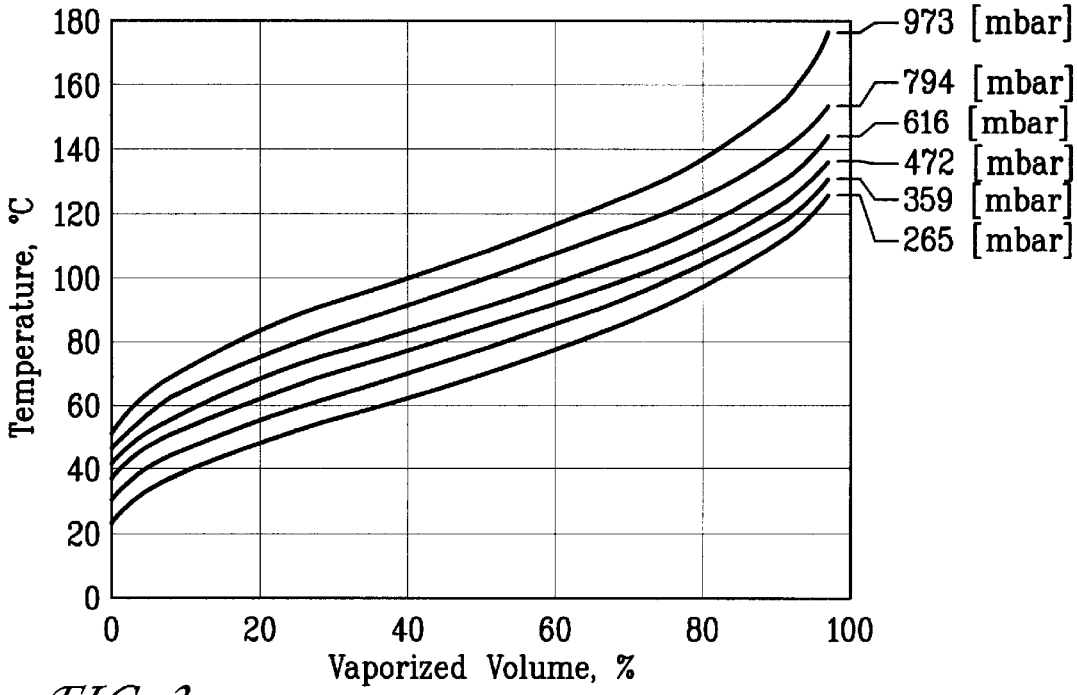
FIGS. 3 and 4 show the usual vapor curves for trade fuel below and above atmospheric pressure, respectively.
Figure 4:
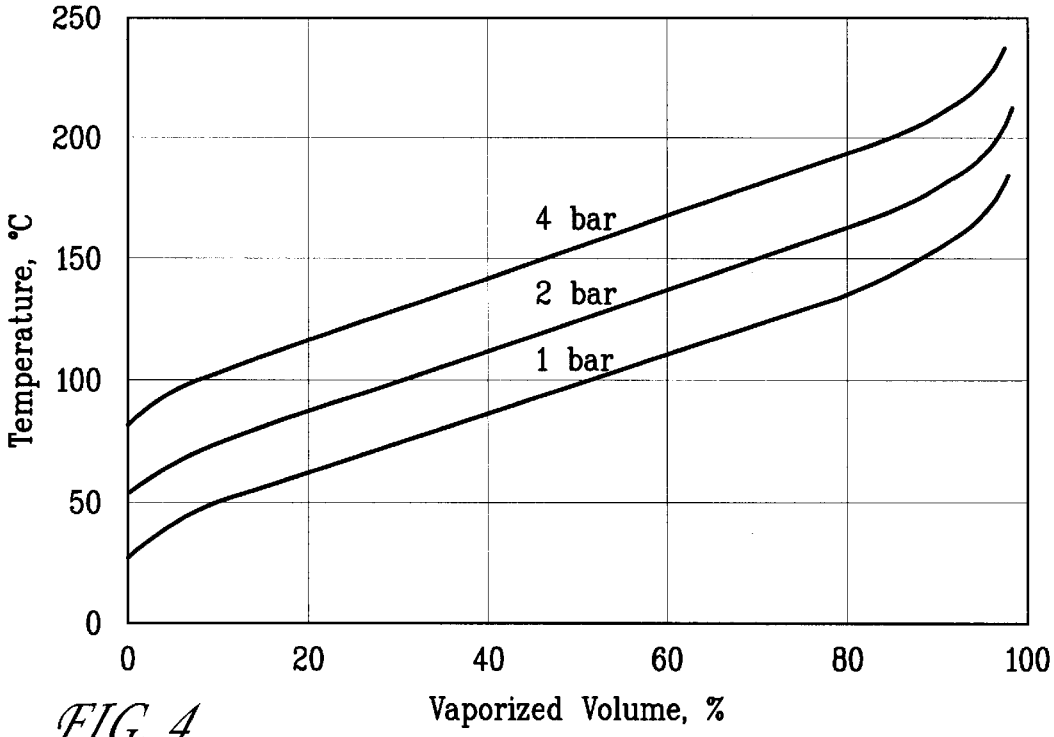

The graphs in FIGS. 3 and 4 indicate that to vaporize almost 100% of the fuel, the fuel temperature must be approximately 130° C. at idle speed (400 mbar). The fuel temperature must be 145° C. to 180° C. to vaporize most of the fuel at part load (700 mbar) and full load (1000 mbar) conditions.

However, even higher fuel temperatures are needed to avoid a phase change from vapor to a liquid in the manifold. Very fast vapor generation during flash boiling quickly cools the fuel vapor because the vaporization heat is detracted from the fuel. Therefore, the temperature during cooling must be prevented from falling below the critical mixture temperature at which vapor condenses to liquid. This temperature depends on pressure, fuel volatility, and the lambda value (lambda is the actual air/fuel ratio divided by the stoichiometric air/fuel ratio). It is 14° C., 26° C., and 34° C. for stoichiometric lambda at idle speed, and part load and full load conditions, respectively. The needed fuel temperature for complete fuel vaporization can be calculated through the cooling temperature at complete vaporization $\Delta T_f$.

$$\Delta Tf = \frac{r_f}{C_{pf}} = 150° \text{ C.} \quad (1)$$

$r_f$ —vaporization heat $C_{pf}$ —specific heat of fuel

The necessary fuel temperatures inside an injector are: 165° C., 177° C. and 185° C. for idle speed, and part load and full load conditions, respectively. An estimated 15 bar fuel pressure is needed to avoid boiling inside the injector at these temperatures. Higher fuel pressure is needed to fully vaporize the fuel during part-and full-load conditions.

Because system costs for vehicles will significantly increase with such a high fuel pressure for port fuel injection, it is unrealistic to dimension the heated tip injector as a 100% vaporizer. However, even if only a limited percentage of fuel will be vaporized, fuel atomization will be enhanced. The energy released through the liquid-to-vapor phase shift of the highly volatile fuel constituents intensifies the break-up mechanism for the less volatile constituents.

EXAMPLE

At the 6 bar fuel pressure chosen for the heated tip injector design, a 100° C.-fuel temperature can be reached inside the injector without bubble formation (see FIG. 3). Seventy-five percent of the fuel volume can be evaporated under the idle speed condition if the fuel exits the orifice disk. Fifty-five percent and 35% of the fuel can be evaporated under part-load and full-load conditions, respectively (see FIG. 3). The energy needed to heat the fuel from 20° C. to 100° C. can be estimated using the following equation:

$$Q = C_p \cdot \Delta T \cdot m \quad (2)$$

Q=heat up power $C_p$=specific heat of fuel

ΔT=heat up temperature m=fuel flow

Assuming an injector's dynamic flow at idle speed is about 0.1 g/s, the energy needed to heat the fuel is about 20 W. The power consumption increases for higher flow rates or colder fuel temperatures. For instance, at −7° C., the heat up power is 125 W at part load or about 25 W at idle speed. Using a 4-cylinder or 6-cylinder engine, the energy consumption of the Heated Tip Injectors totals 80 W or 120 W, respectively. Measurements showed that actual requirements are about 50% higher because some of the energy provided is absorbed through the injector into its environment.

Numerical Analysis

Because the Heated Tip Injector is designed to enhance atomization during cold starts, the energy has to be transferred as quickly as possible from the heater into the liquid. Numerical calculations, using computational fluid dynamics models, were performed to analyze the heat transfer process inside the injector, and identify the key parameters in shaping the heating process of the liquid fuel.

The computational domain covered the region from the top of the valve body to the injector exit, where the heater is located and most of the pressure drops occur. The simulations were performed in two dimensions: assuming axial symmetry and using a cylindrical coordinate system. It was assumed that the velocity and pressure fields reached a steady state much faster than the temperature field. Therefore, each calculation consisted of two steps. The steady state continuity and momentum equations were solved in the first step when the injector was held fully open at a 90 $\mu$m lift. The transient heat transfer process was solved in the second step. The pressure and velocity fields determined in the first step calculations were part of the initial conditions used in the second step calculations. The flow was assumed to be turbulent in all calculations, and the RNG k-ϵ model was used to simulate the turbulence effect. To simplify the analysis, the heat transfer within the needle and valve body was not considered.

The pressure boundary conditions were applied at the inlet and outlet, with a pressure differential equal to 0.6 MPa for the baseline case. The temperature profile at the heater surface was measured and used as a temperature boundary condition at the wall representing the heater. The free convection between the injector body and surrounding air was assumed to be zero. The heater was assumed to be turned on at time zero, when the flow field reached the steady state. The initial injector body and liquid fuel temperatures were assumed to be 20° C. N-heptane, used as the working fluid, has the physical properties shown in Table 1.

TABLE 1

| N-Heptane Physical Properties | |
|---|---|
| Density (kg/m$^3$) | 683.7 |
| Specific Heat (J/kg K) | 2219 |
| Viscosity (kg/m sec) | 0.00041 |
| Thermal conductivity (W/K m) | 0.14 |

Results

Figure 5:
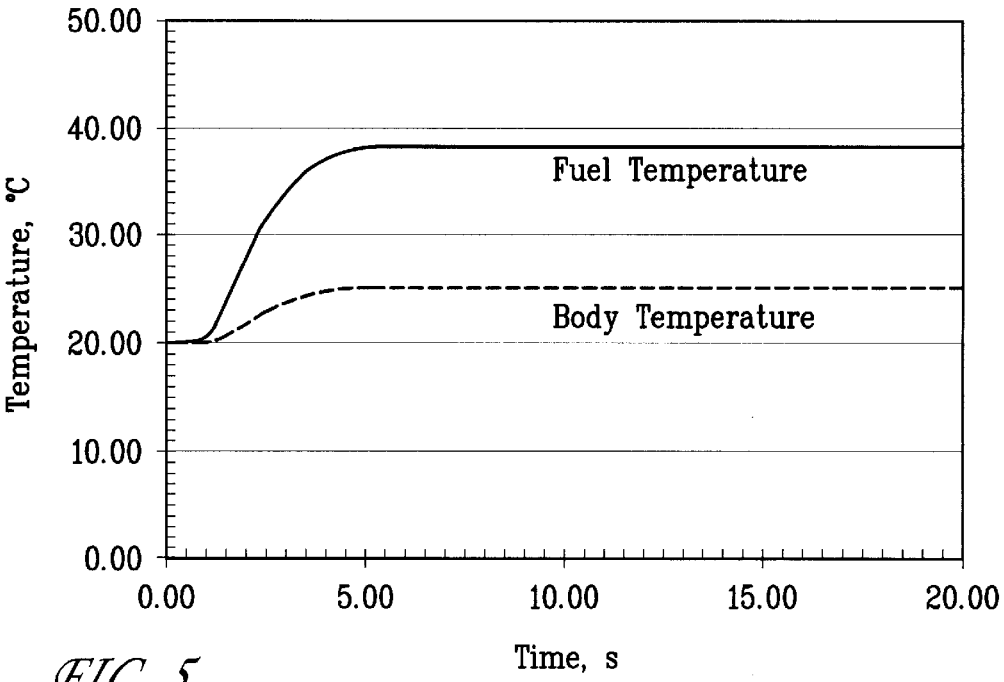
FIG. 5 fuel temperature at injector exit and injector body temperature.
Figure 6:
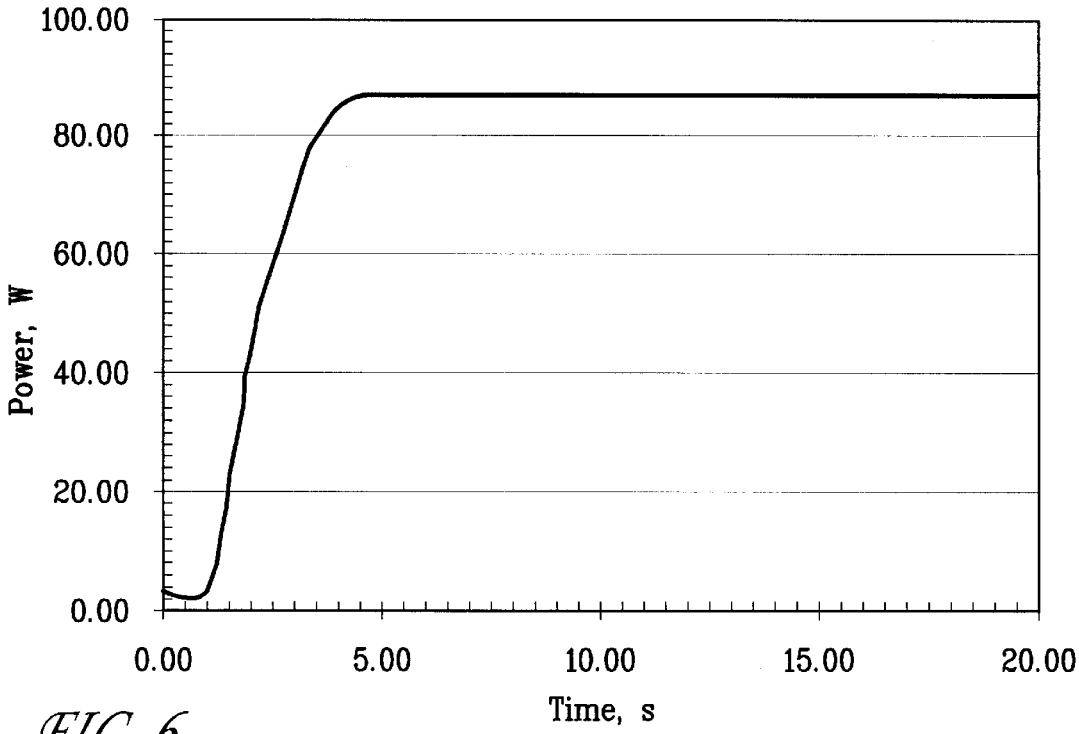
FIG. 6 shows power input at the heater surface.

As stated earlier, the baseline calculation was performed when the injector was held fully open, which simulates the static flow condition and is the worst case for the fuel heating process. FIG. 5 shows the fuel temperature at the injector exit. The injector body temperature profile is also shown. The injector needed only 4.5 seconds to heat the fuel to the required temperature. The steady state fuel temperature was 38.4° C., which was much lower than the fuel temperature when the injector was operating under the pulsation model. The body temperature reached the maximum value of 25.2° C. about 5 seconds after the heater turned on. The power input to the liquid fuel is shown in FIG. 6.

Figure 7:
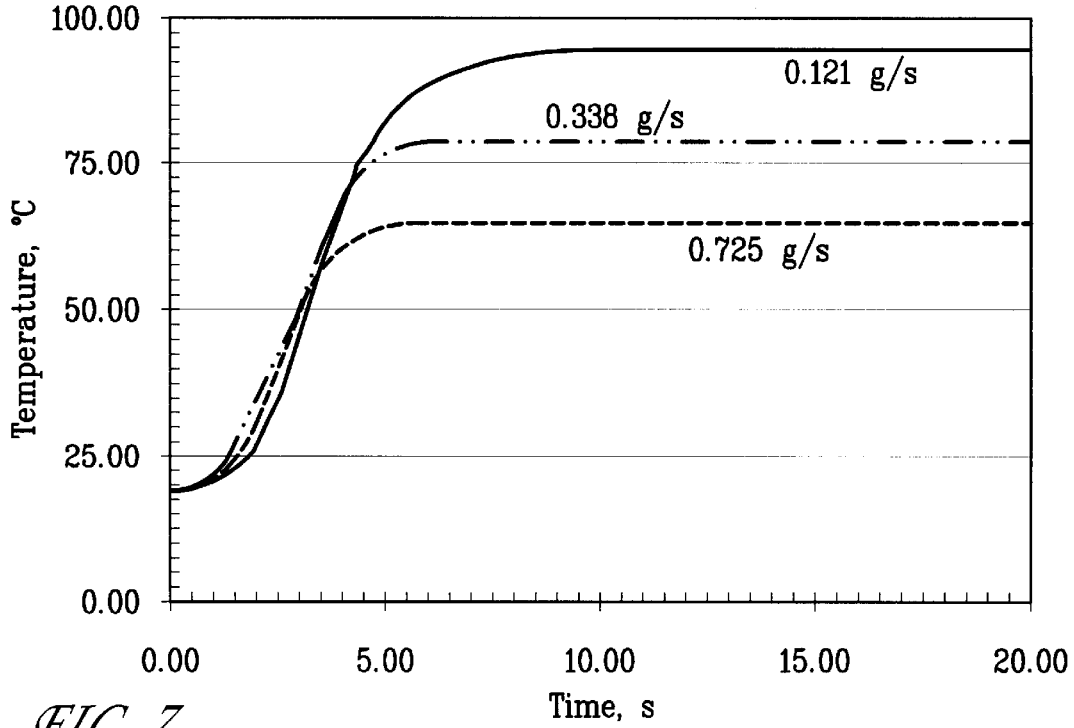
FIG. 7 shows fuel temperature at the injector exit.
Figure 8:
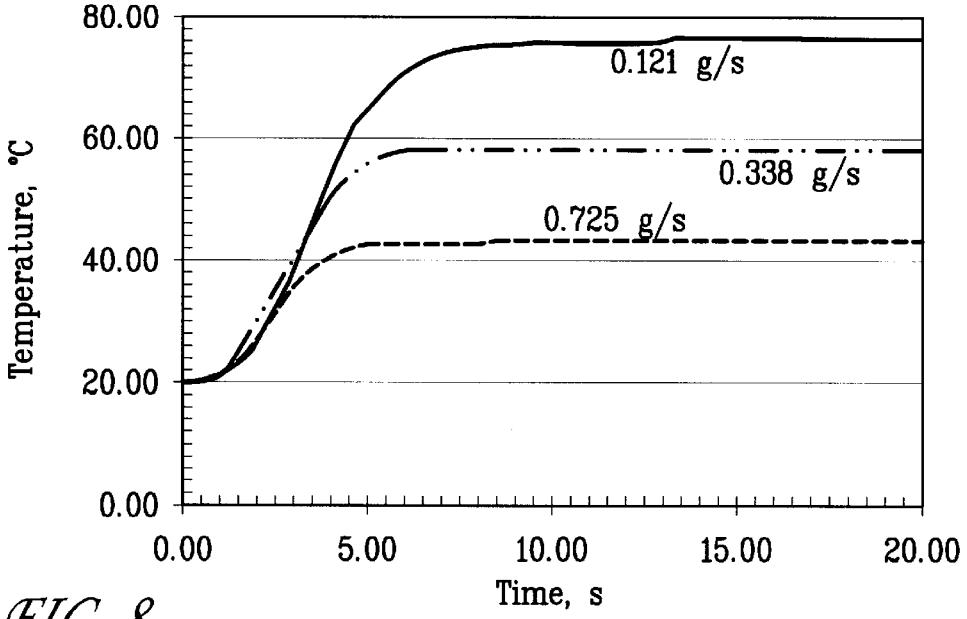
FIG. 8 shows injector body temperature.
Figure 9:
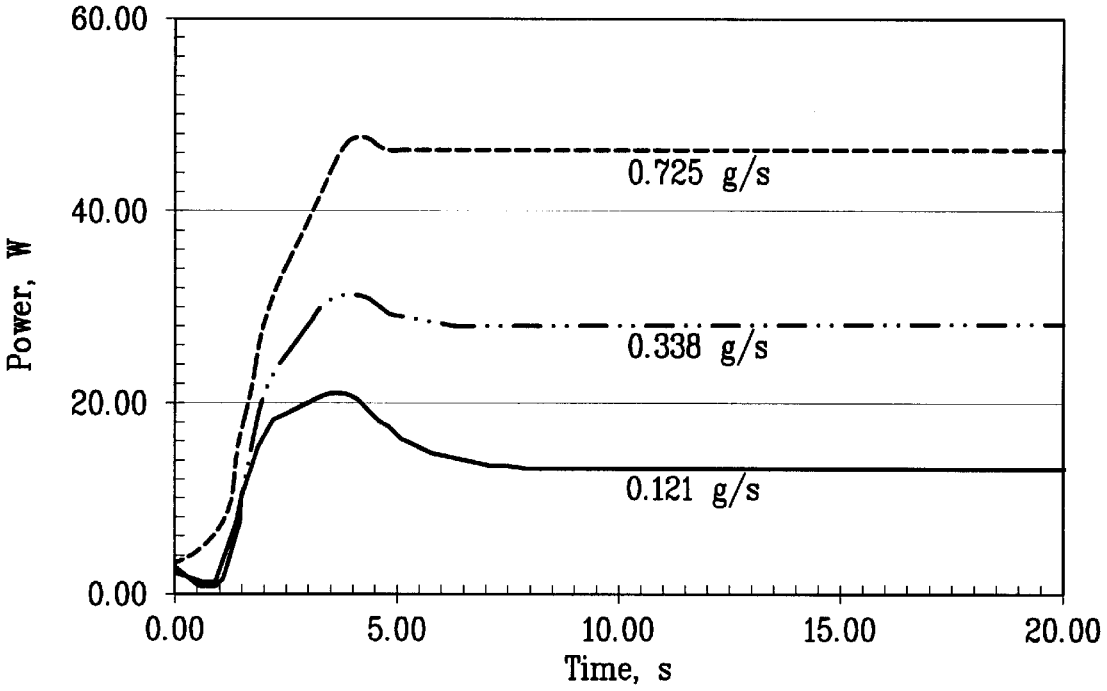
FIG. 9 shows power input at heater surface.

To simulate the injector's pulsating operation mode, the mass flow rates of 0.121 g/s, 0.338 g/s, and 0.725 g/s were applied at the inlet boundary. The mass flow rates represented the pulse widths/pulse periods of 5 ms/120 ms, 7 ms/60 ms, and 10 ms/40 ms, respectively. FIG. 7 depicts the fuel temperature profile at the injector exit, and FIG. 8 shows the injector body temperature for three cases. It is clear that a lower mass flow rate resulted in a higher steady state fuel temperature, with a slightly slower heating process. The power input to the liquid fuel is shown in FIG. 9. A lower mass flow rate consumed much less power, even if it resulted in a higher exit temperature.

Figure 10:
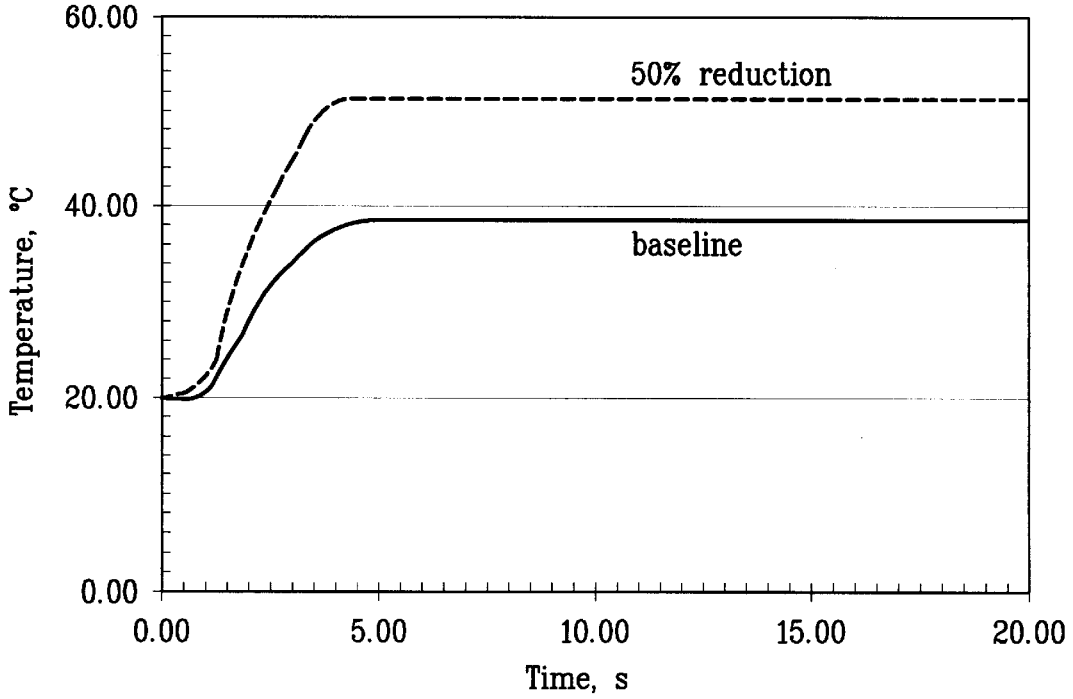
FIG. 10 shows flow passage effect on fuel temperature at injector exit.

Because the injector heater was between the needle and valve body, the size of the flow passage surrounding the heater was expected to significantly affect exit fuel temperature. To study this effect, calculations were performed with a modified valve body in which the cross-section area of the flow passage was reduced by 50%. A comparison of the resulting fuel temperature at the injector exit with the baseline temperature (see FIG. 10) showed a higher steady state temperature.

Figure 11:
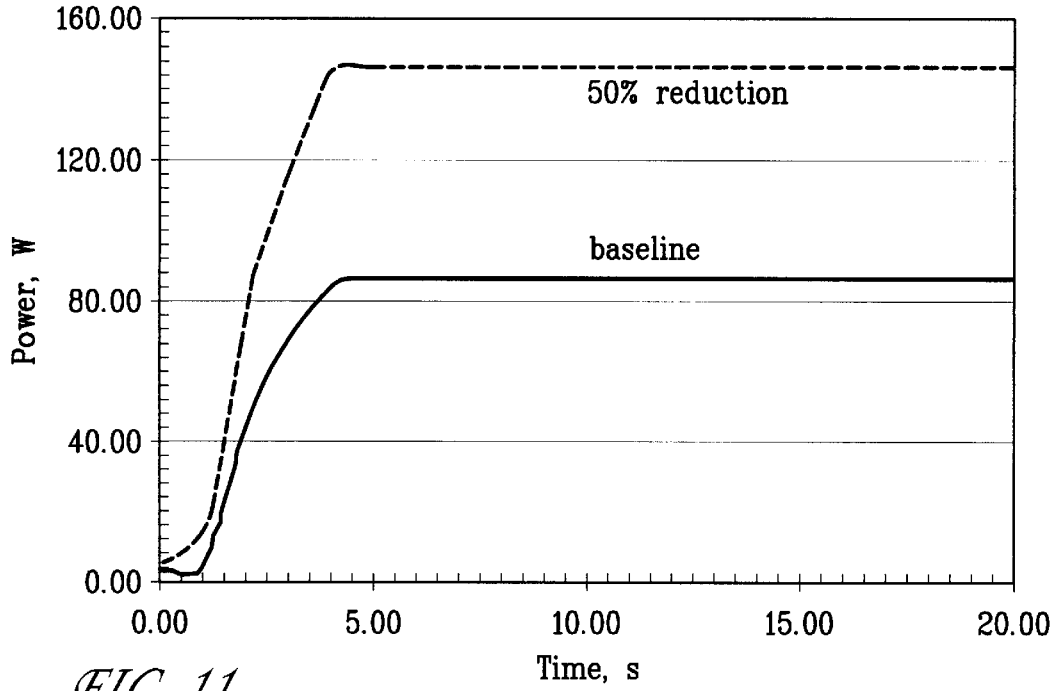
FIG. 11 shows the effect of flow passage on power.

The time needed to reach the steady state temperature was about the same for both cases. A comparison of the power inputs for both cases (see FIG. 11) showed that reducing the flow passage increased the power consumption. The mass flow rates were kept the same in both cases.

Injector Performance

Temperature Vs. Time—Temperature measurements were made to study the Heated Tip Injector's performance in detail. A thermocouple was placed in direct contact with the fuel at 1.5 mm below the orifice, and was thermally isolated from the injector. The thermocouple's response time was 40 ms, and data was acquired at a sample rate of 100 Hz. All temperature measurements were made in N-Heptane.

Figure 12:
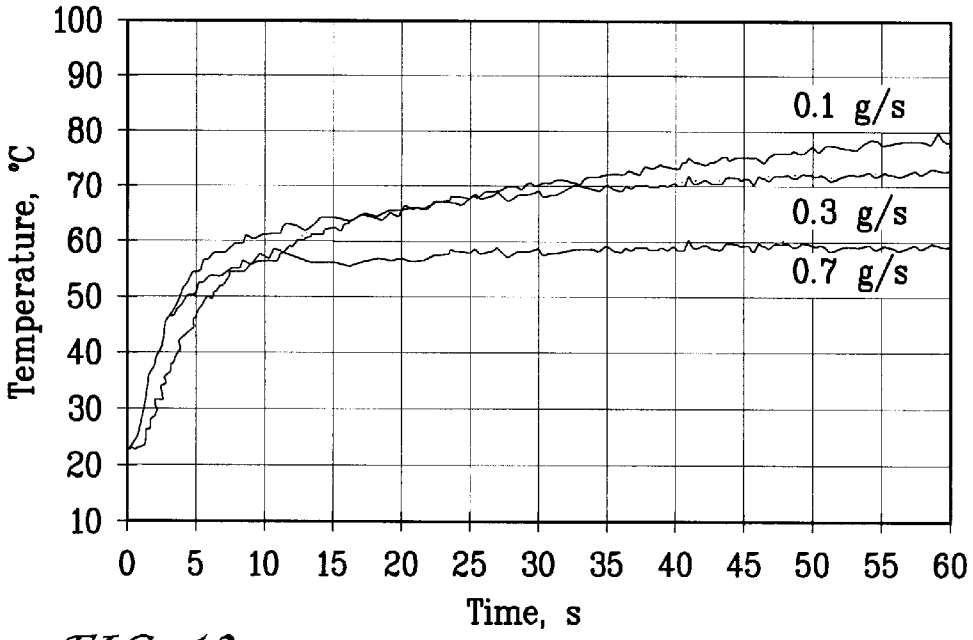
FIG. 12 shows temperature curves for a basic geometry injector.

FIG. 12 shows the temperature curves for a basic geometry of the Heated Tip Injector and for different dynamic flow rates. The graph shows that the temperatures depended on the flow rates: higher final temperatures were achieved with lower flow rates. The temperature was about 80° C. after 60 seconds at 0.1 g/s and about 60° C. at 0.7 g/s. However, the first 5 seconds showed a steeper temperature slope for higher flow rates. A temperature of 55° C. was achieved at a flow rate of 0.3 g/s, whereas only 45° C. was reached at 0.1 g/s.

The heat transfer of the fluid flow over the heater was affected by a variety of factors, including: flow pattern characteristic, fluid properties, flow passage geometry, and surface condition. A simple explanation is: because fuel heat is partially lost to the injector tip, heating time is slower at low flow rates. More time is required to overcome the thermal mass of the injector body and tip due to a lower mass of fuel flowing. Equilibrium temperatures at higher flow rates are lower than for lower flow rates because cold fuel is introduced into the injector.

Figure 13:
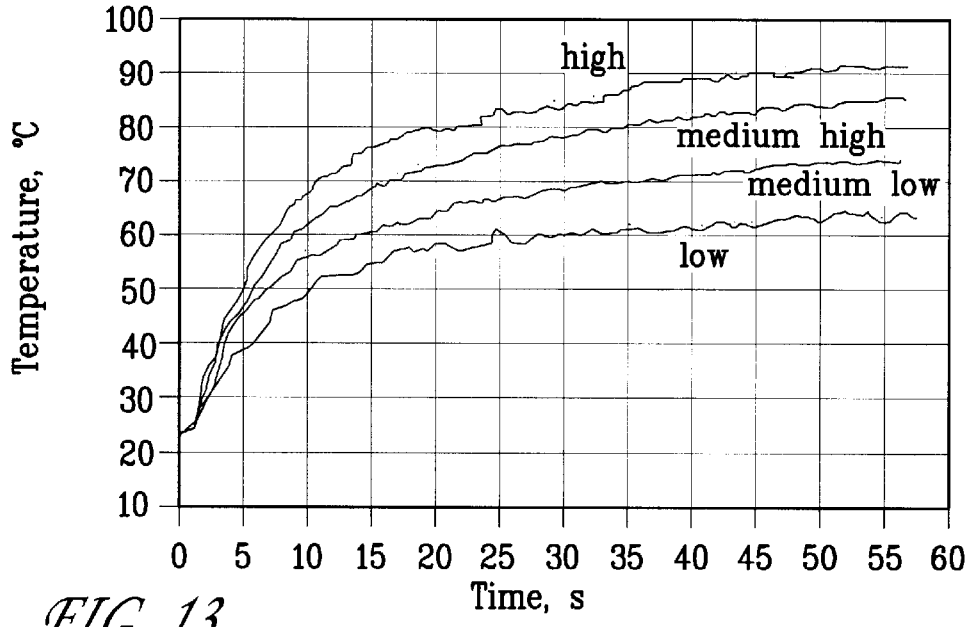
FIG. 13 shows temperature curves for different heater temperatures at 0.1 g/s.

The heater's performance was determined in part by its surface temperatures. Higher heater surface temperatures improved the injector's performance (see FIG. 13). The temperature difference between the heater's surface and the liquid increased and, therefore, more energy could be transferred into the liquid. However, potential improvement in performance is limited due to bubble development inside the injector.

Therefore, performance improvement should focus on internal injector geometry changes to increase the heat transfer from the heater to the fuel. An easy way to do this is to increase the heater's surface area: more surface area means more fuel is heated at the same time.

Figure 14:
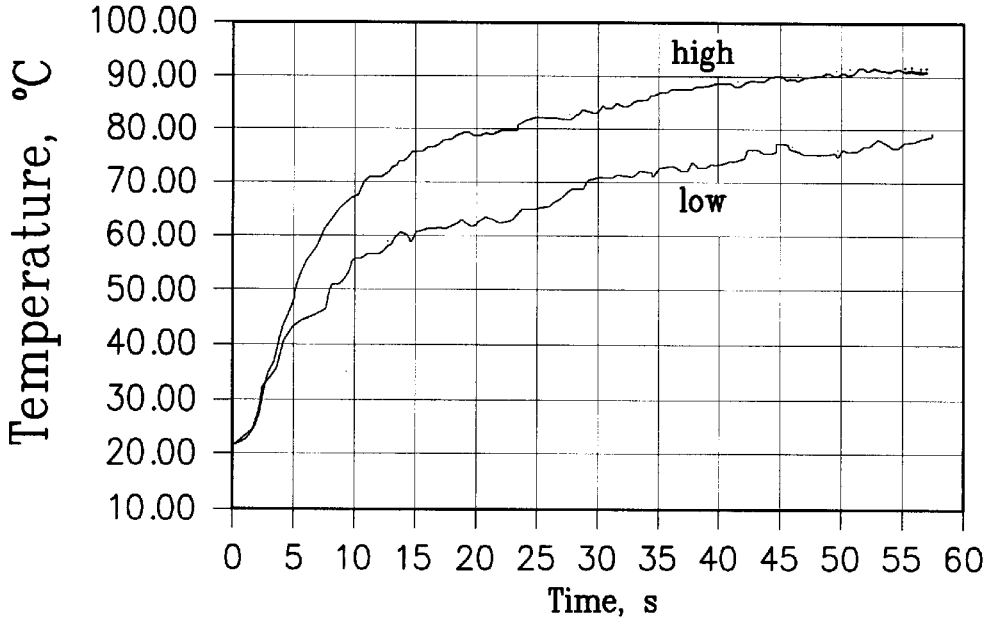
FIG. 14 shows temperature curves for two heater surfaces at 0.1 g/s.

FIG. 14 depicts the difference in injector performance at high and low temperatures. The higher temperature curve was achieved with a heater that provided twice as much surface area as the heater that produced the lower curve. The temperature difference between the curves was about 15° C. after 15 seconds and 10° C. at 5 seconds. Unfortunately, the size of a fuel injector and the design feasibility of heaters are limited. Therefore, the heater surface area cannot be increased infinitely.

Another way of improving the heat transfer was by changing the fuel velocity around the heater. As shown in FIG. 12, the temperatures varied with the dynamic flow rate. Therefore, decreasing the flow area around the heater can be designed to enhance the heat transfer at low flow rates.

Figure 15:
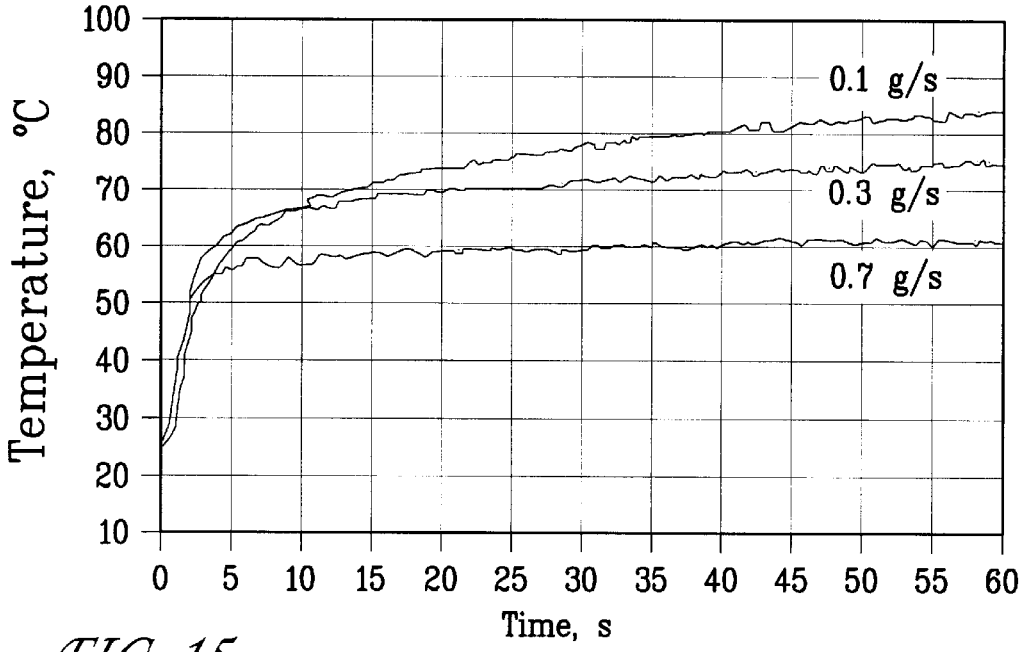
FIG. 15 shows temperature curves for two flow areas around the heater at 0.1 g/s.

FIG. 15 shows the results with a flow area around the heater that was decreased by 70%. It shows a significant improvement at a lower flow rate (0.1 g/s), compared to the basic geometry design (see FIG. 12). The temperature increased much faster. More than a 10° C. difference was seen after 5 seconds. At lower temperatures, there were no significant differences. Obviously, the fuel flow was already too high to transmit enough heat into the liquid.

To increase heat transfer, a turbulator was introduced into the injector to generate a tumbled flow around the heater. FIG. 16 shows the temperature curve from an injector with a turbulator, which magnifies the heat flow from the heater into the fuel. Temperatures of 90° C., 85° C. and 70° C. were measured after 60 seconds for 0.1 g/s, 0.3 g/s, and 0.7 g/s, respectively. The temperature difference was about 10° C., compared to the basic geometry design (see FIG. 12). Even more effective for the Heated Tip Injector were the improvements shown at 5 seconds. The temperatures at this point were: 63° C., 73° C. and 55° C. with the turbulator, compared at 55° C., 52° C. and 47° C. without a turbulator. Clearly, the best improvement was at a flow rate of 0.3 g/s.

The temperature measurements showed that fuel was quickly heated to 70° C. inside the Heated Tip Injector at flow rates needed for idle speed. The testing showed additional potential to improve the temperature response. The following section covers how the fuel spray changes for hot fuel under vacuum conditions.

DROPLET SIZE—to evaluate spray quality, phase doppler particle analyzer measurements were made at 50 mm from the injector tip under five different conditions: heat on, and dynamic flow rates of 0.1 g/s and 0.3 g/s, and 40 kPa and 70 kPa back pressure. The spray baseline was evaluated at a 0.3 g/s flow rate and 100 kPa back pressure. All measurements were made using indolene and the basic geometry design of the Heated Tip Injector.

FIG. 17 shows a typical plane at 50 mm below the injector tip for the volume flux of a split stream injector with the heat off. The droplet size was measured at 91 points in the plane. Samples were taken in incremental steps by 5 in x and y positions, starting at pint 0.0. The X axis ranged from positions −15 to +15 mm, and the Y axis ranged from positions −30 to 30 mm. The Sauter Mean Diameter (SMD) and the volume distribution of droplets were calculated from the measured volume at the described plane.

Heat Off

FIG. 18 represents a typical spray when the heater is turned off. A split stream with well-defined cones can be seen. No significant differences in the spray formation were observed after changing vacuum and flow conditions when the heater was turned off.

FIGS. 19A and 19B show the droplet size vs. time, and the number of droplets and the cumulative volume vs. diameter of the shown spray.

Analyzing the droplet size vs. time diagram, droplets of about 100 $\mu$m were shown in the beginning of the injection. These big droplets were primarily caused by the injector's sac volume. When the injector was closed, the last passing droplets at the measurement probe were about 50 $\mu$m. More than 90% of the injected volume was measured from when the first big droplets were present to the last small droplets.

The SMD was calculated from the measured volume stream. At 106 $\mu$m SMD was found with non-heated fuel. This droplet size was 20 $\mu$m to 50 $\mu$m smaller, compared to standard port fuel injectors at pressure rates between 270 kPa and 400 kPa.

FIG. 19B, representing the number of droplets vs. diameter, shows that even though the SMD is 75 $\mu$m, a few large droplets accounted for most of the injected volume. Droplets with particle sizes below 100 $\mu$m represented only 50% of the injected fuel volume.

Heat On

FIGS. 20A and 20B show the spray for a 0.1 g/s flow rate and 0.3 g/s at 70 kPa vacuum back pressure. It clearly shows that the fuel spray lost its original pattern. A closer look at the spray origin shows the included angle at the injector tip is slightly wider for the lower flow rate of 0.1 g/s. More fuel evaporates at lower fuel flow rates because of higher fuel temperatures.

The analysis of the volume flux in FIGS. 21A and 21B confirms the observation made from FIGS. 20A and B. A wider spray pattern for lower flow rates can be recognized, and the original spray pattern disappears.

With a lower back pressure of 40 kPa, even more fuel will evaporate (see FIGS. 23A and B). A wider angle at the injector tip is observed for both analyzed flow rates, compared to the spray pattern at 70 kPa back pressure. A significant atomization can be seen at 0.1 g/s and 40 kPa back pressure (see FIGS. 22A and B).

The volume flow at 0.3 g/s was more scattered, but it still included large areas with higher volume flux. Less area with high volume flux was observed at 0.1 g/s flow rate. Most of the fuel was vaporized under these conditions, which leads to a uniform spray.

Figure 24A:
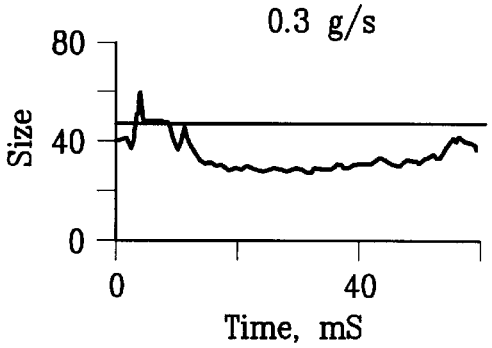
FIGS. 24A and 24B show drop size vs. time at 70 kPa back pressure.
Figure 24B:
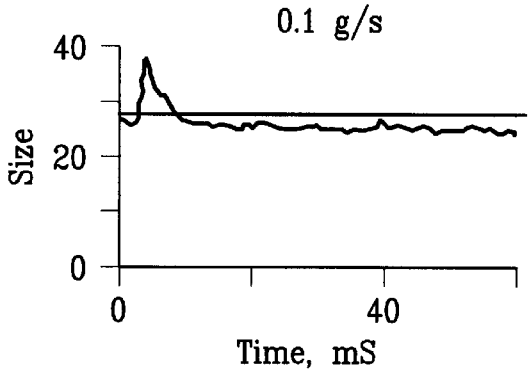
Figure 25A:
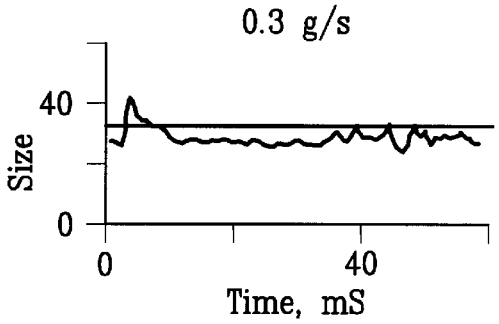
FIGS. 25A and 25B show droplet size vs. time at 40 kPa back pressure.
Figure 25B:
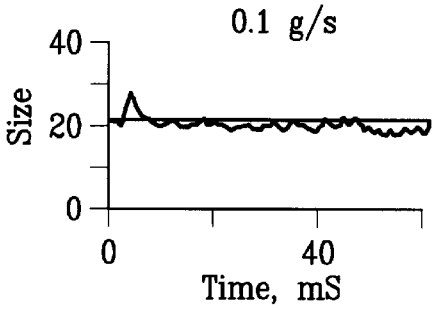

The effect of evaporation can be quantified by the droplet size distribution (see FIGS. 24A and B and 25A and B). The SMDs at 40 kPa back pressure, 0.1 g/s and 0.3 g/s, as well as at 70 kPa back pressure, 0.1 g/s and 0.3 g/s, were: 21 $\mu$m, 32 $\mu$m, 28 $\mu$m and 47 $\mu$m, respectively. The biggest droplets measured at the injection start were about: 28 $\mu$m, 40 $\mu$m, 38 $\mu$m, and 60 $\mu$m, respectively. Compared to the non-heated mode, the SMD and the biggest measured particles were significantly smaller.

Figure 26A:
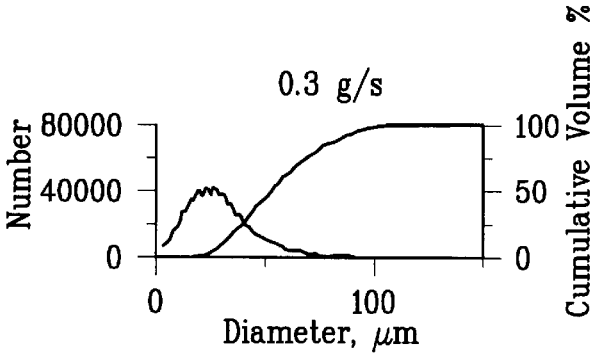
FIGS. 26A and 26B show number and cumulative volume vs. diameter size vs. time at 70 kPa back pressure.
Figure 26B:
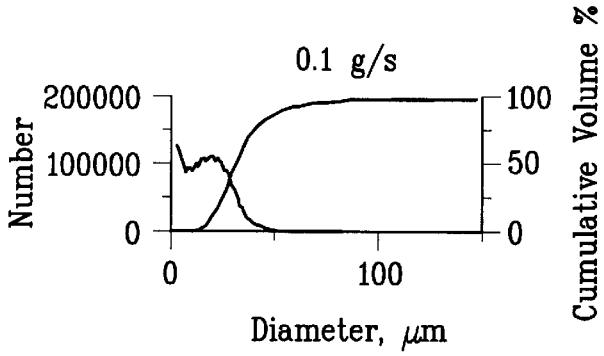
Figure 27A:
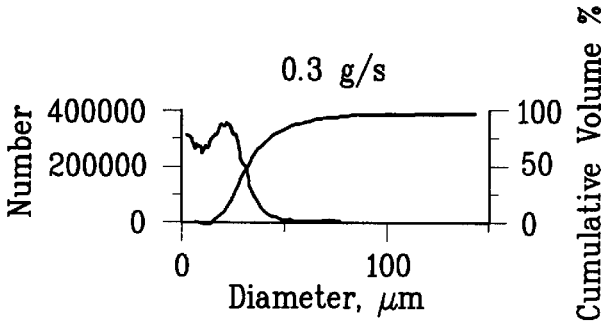
FIGS. 27A and 27B show number and cumulative volume vs. diameter size vs. time at 40 kPa back pressure.
Figure 27B:
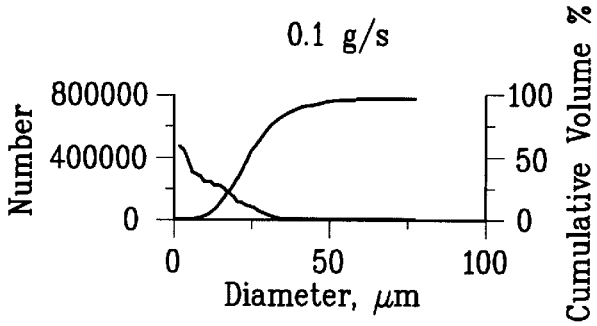

In addition, FIGS. 26A and B and 27A and B show great improvement concerning smaller droplets in the injected volume. Almost 100% of the volume had a droplet size smaller than 50 $\mu$m at 0.1 g/s and 40 kPa back pressure. About 50% of the spray consisted of particles that were less than 25 $\mu$m under these conditions. This was four times smaller than the spray measured under the non-heated condition.

At a higher fuel flow of 0.3 g/s and a higher back pressure of 70 kPa, the improvements, compared to the non-heated condition, were still significant. Almost all particles were smaller than 100 $\mu$m, and 50% of the volume showed particle sizes of less than 50 $\mu$m.

Engine Analysis

A modern, 1.4 liter, four-cylinder, four valves per cylinder, multi-point injected engine driving an engine dynamometer was used to evaluate the Heated Tip Injector's performance. Injection and ignition timing sweeps, load steps, and room temperature starts have been used to evaluate spray preparation and targeting for various injector designs for many years.

Figure 28:
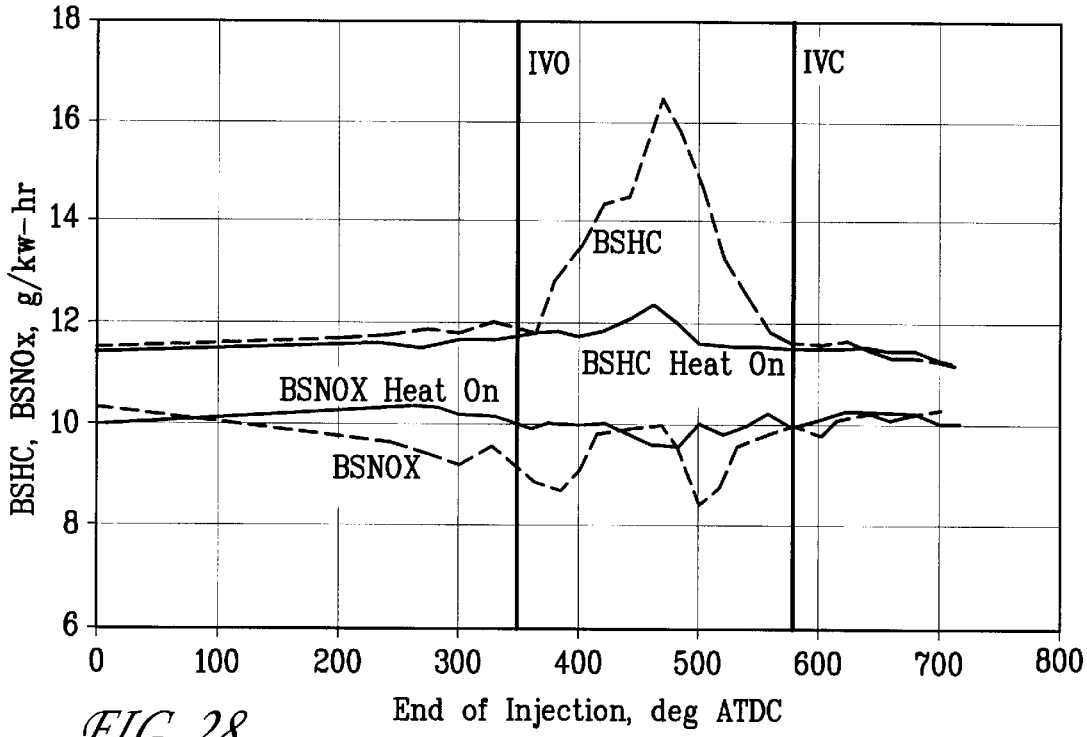
FIG. 28 shows an injection timing sweep showing brake specific HCs and brake specific Nox as a function of end of injection.

FIG. 28 shows the results of an injection timing sweep, comparing the performance of Heated Tip Injectors with and without the heaters turned on. The engine was kept at a load of 262 kPa brake mean effective pressure (BMEP), 1500 rpm, ignition timing at 21° before top dead center (°BTDC), lambda equal to 1, and the coolant forced cooled to 40° C. to approximate a warm-up condition. Brake specific hydrocarbons (BSHC) and brake specific NOx (BSNOx) are plotted as a function of the end of injection, expressed in crank angle degrees after top dead center (°ATDC). Also in the figure are the intake valve opening and closing events. Combustion typically degrades during open valve injection with standard injectors. This was true here when the heaters were not energized. The combustion degradation was shown as an increase in HCs and a decrease in NOx emissions between intake valve opening and intake valve closing. This was presumably caused because liquid fuel was inducted into the combustion chamber producing locally rich areas.

FIG. 28 also shows that when the heaters of the Heated Tip Injectors were energized, the HC emissions did not significantly increase during the open valve injection and, in fact, decreased slightly for the standard injection timing of 308° ATDC. Similarly, the NOx emissions did not decrease during the same time, signifying little if any combustion degradation. This showed that the Heated Tip Injectors were effectively vaporizing the fuel to provide a mixture quality in the combustion chamber similar to when the fuel is prevaporized on a hot intake valve. The application engineer can use the transient benefits of open valve injection on a cold engine without the usual emissions penalty.

Figure 29:
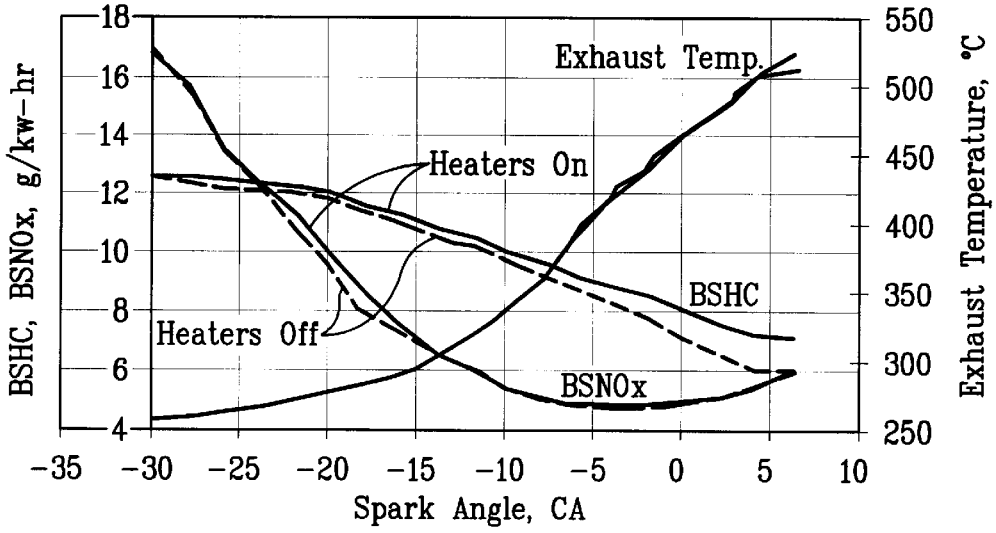
FIG. 29 shows an ignition sweep showing brake specific emissions and exhaust temperature as a function of ignition timing.

FIG. 29 shows the results of an ignition timing sweep. BSHC, BSNOX, and exhaust temperature are expressed as a function of ignition timing, comparing the performance of the Heated Tip Injector with (solid lines) and without (broken lines) the heaters energized. The engine was operated at 262 kPa BMEP, 1500 rpm, stoichiometric AFR, and with a coolant at 40° C. The end of injection was at 308° ATDC (closed intake valve). Like the injection timing sweep, results showed a slight decrease in HC emissions when the heaters were energized, especially at retarded ignition timing. Otherwise, the engine performance did not suffer as compared to the unheated case. This allows the application engineer to successfully apply normal catalyst light-off strategies.

Load steps at constant engine speed were used to evaluate the impact of various injector designs on the size of the fuel wall film in the intake passages of forced cooled engines. In general, if an engine is operated with open loop fueling (i.e., all transient algorithms normally in the injection control algorithms are disabled, and the mass of injected fuel is strictly a function of air inducted into the engine) the area under the lambda curve through a load step is proportional to the change in the mass of the wall film during the step. Therefore, the degree of wall wetting in the intake passages, caused by the ability of an injector design to target the intake valves, can be evaluated by integrating numerically or through observing the area under the lambda curve through a load step. The practical significance to the wall film size is especially great in a cold engine when the film is so large that the engine control algorithms cannot completely compensate for the resulting lambda excursions. These excursions adversely impact the engine raw emissions, as well as catalyst light-off times and efficiencies.

Figure 30:
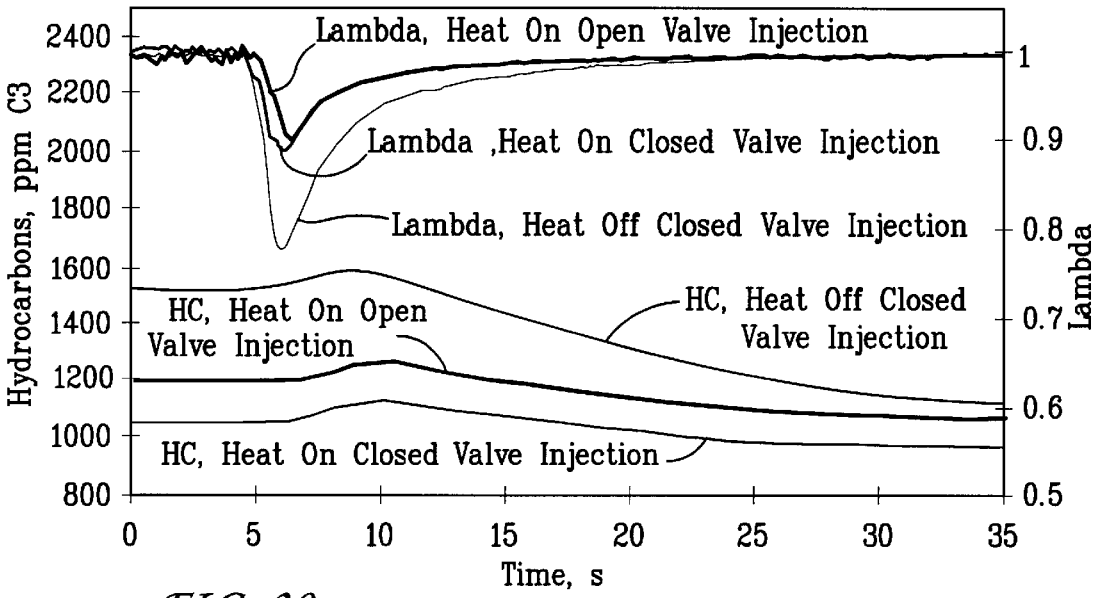
FIG. 30 shows HC emissions and lamda during a negative load step.
Figure 31:
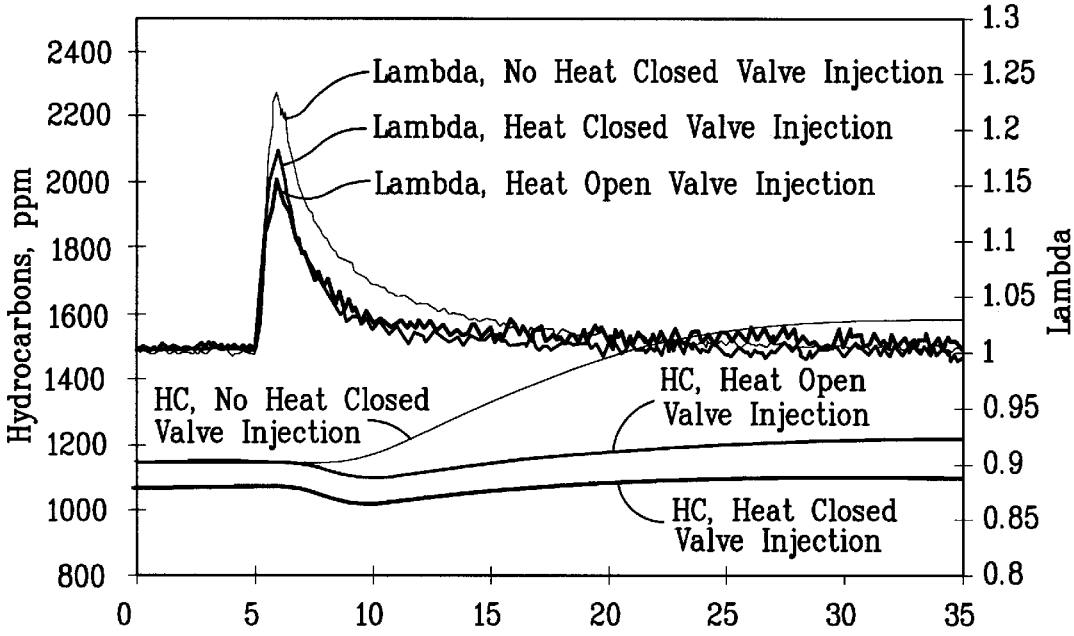
FIG. 31 shows HC emissions and lamda during a positive load step.

FIG. 30 compares the performance of the Heated Tip Injectors with the heaters energized with the baseline case of the same injectors without the heaters energized, during a load step at constant speed. The end of injection timing for the baseline case (heat off) was 308° ATDC (closed valve injection), and 450° ATDC (open valve injection) with the heaters energized. Engine speed was controlled to 1500 rpm, and the coolant was controlled to 40° C. The negative load step (tip-out) was defined by a transition from the intake manifold pressure of 95 kPa to 45 kPa in 1 second. All traces shown in the figure were an average of six separate load steps. The figure shows that the area under the lambda trace was minimized (minimum wall film change) by the Heated Tip Injectors with the heaters energized during open valve injection. The injectors' performance with heaters energized with closed valve injection was very close to the open valve injection case, indicating the vaporized fuel does not have time to condense on the walls (FID). Again, a slight HC advantage was seen when the heaters were energized and closed valve injection was used. It is significant that the HC concentration was not as strong a function of load when the heaters were energized, compared to when they were off. FIG. 31 shows the results of the same load step executed in the opposite direction (i.e., with increasing load). The trends are the same as in FIG. 30.

Room temperature start tests were performed with Heated Tip Injectors. As with all other testing reported here, start tests were performed using a universal laboratory engine controller so that variables such as injection and spark timing could be easily manipulated. Although significant trends were discovered using this apparatus, the start algorithm with this controller was determined to be not sophisticated enough to provide robust starts with the repeatability required for this work. This preliminary work quickly showed that the starts with the lowest HC emissions were achieved using the Heated Tip Injectors with the heaters energized and closed valve injection. Closed valve injection apparently helped put as much heat as possible into fuel vaporization during the start and initial idle. Hence, all starts discussed herein were achieved using the Heated Tip Injectors and the original equipment manufacturer (OEM) engine control unit and algorithms.

Figure 32:
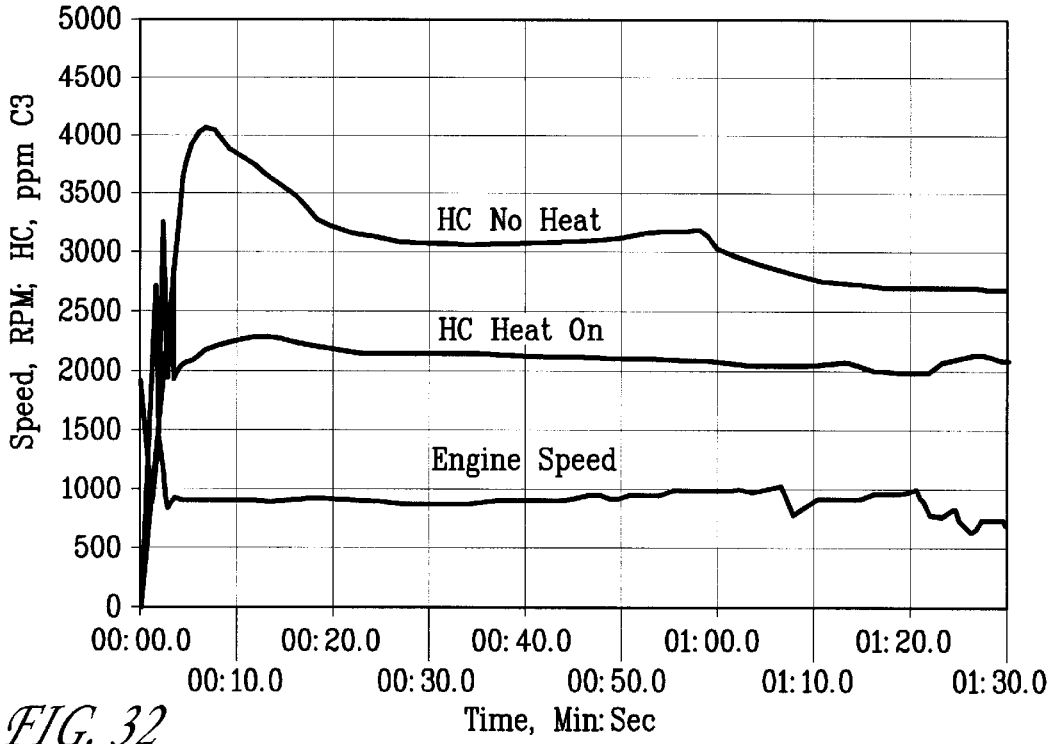
FIG. 32 shows HC emissions for room temperature starts.
Figure 33:
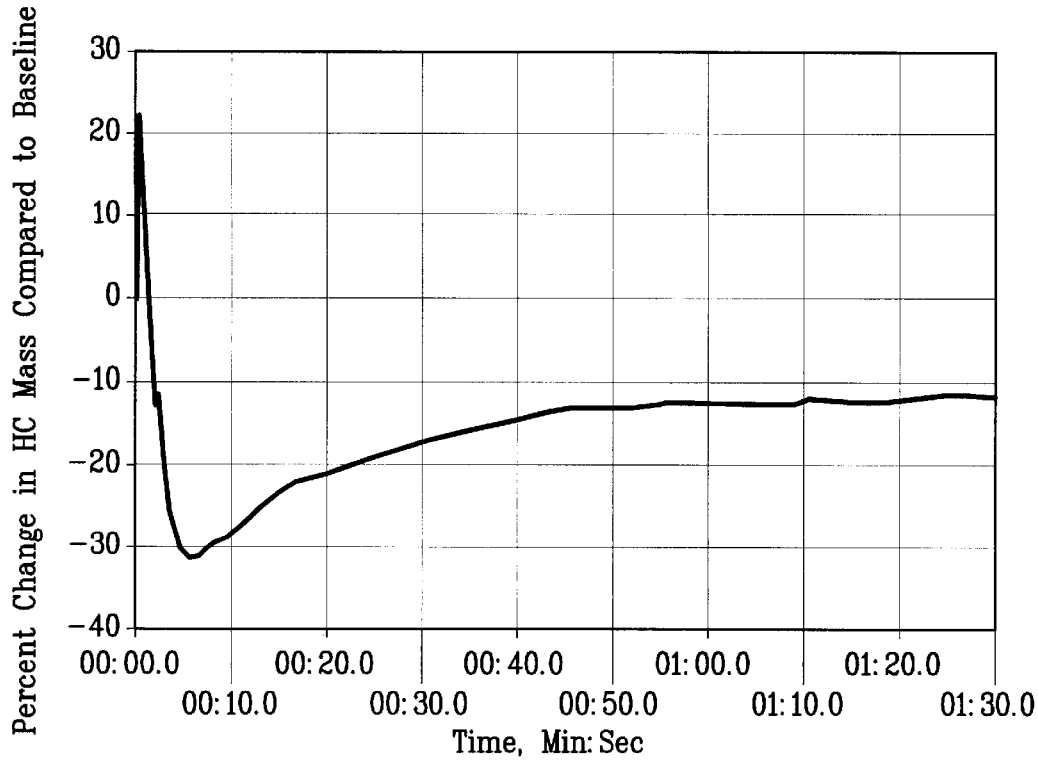
FIG. 33 shows average HC reduction compared to unheated closed valve injection of the heated tip injector.

The engine was started with and without the injector heaters energized. All data presented here was an average of at least five starts with a minimum of six hours of soak time at room temperature between starts. FIG. 32 shows the HC concentration of the exhaust gas and engine speed as a function of time. Engine-out HC emissions were significantly reduced when using the Heated Tip Injector. The HC mass was calculated as a function of time for each case, and is shown in FIG. 33 as a percentage reduction, compared to the unheated baseline. This figure shows that engine-out HCs were reduced on average of 21% in the first 20 seconds after start using the Heated Tip Injector with this engine.

In conclusion, the engine showed:

Use of the Heated Tip Injector in the tested engine demonstrated a 21% reduction of engine-out HC emissions in room temperature starts followed by a 20-second idle. Traditional catalyst warm-up techniques also were successfully applied during this phase.

The excellent spray preparation qualities of the Heated Tip Injector provided excellent transient performance, including a reduced load effect on emissions, and allowed open valve injection with no significant emissions penalties. The implications are improved lambda control in the critical engine and catalyst warm-up phase.

Conclusion

Using the heated tip injector, fuel can be heated to 65° C. within 5 seconds at flow rates between 0.1 g/s and 0.7 g/s. Steady state temperatures ranged between 70° C. and 90° C. Under these conditions, approximately 50% of the fuel was vaporized at low manifold pressures.

Numerical analysis showed that a lower mass flow rate results in higher steady state fuel temperatures with a slightly slower heating process. The analysis also showed that the flow passages surrounding the heater significantly affected the exit temperature of the fuel.

It was also demonstrated that heating time depends on the power of the heater. However, the potential power increase in the heater is limited because of the risk of bubble growth inside the injector.

Particle size measurement showed that hot fuel is very well atomized under vacuum conditions. An SMD of 21 m was measured at an engine idle condition (0.1 g/s, 40 kPa back pressure). More importantly, almost 100% of the particles had droplet sizes smaller than 50 $\mu$m.

Engine test results on a small displacement engine showed a significant reduction in engine-out HC emissions and excellent transient performance. Open valve injection is possible with no significant emissions penalties.

While the invention has been disclosed with reference to certain preferred embodiments, numerous changes, modifications and alterations to the disclosed embodiments are possible without departing from the spirit and scope of the invention, as described in the appended claims, and equivalents thereof.

What is claimed is:

1. A method of heating fuel using a heated tip fuel injector, comprising:

providing an internal combustion engine having at least one fuel injector, the at least one fuel injector having an internal heater;

substantially simultaneously energizing an engine starter and the internal heater; and substantially simultaneously changing a load on the engine and switching to open valve injection, after the injecting fuel using closed valve injection.

2. The method of claim 1 further comprising: de-energizing the internal heater after the energizing and after catalyst light-off.

3. The method of claim 2, wherein the injecting fuel using closed valve injection occurs substantially simultaneously with the de-energizing.

4. The method of claim 1, further comprising:

switching from the open valve injection to closed valve injection substantially simultaneously with catalyst light-off.

5. The method of claim 1, wherein the providing includes providing an internal combustion engine having a plurality of fuel injectors, each of the plurality of fuel injectors including an internal heater.

6. A method of heating fuel using a heated tip fuel injector, comprising:

providing an internal combustion engine having at least one fuel injector, the at least one fuel injector having an internal heater;

starting the engine; and then energizing the internal heater;

injecting fuel using closed valve injection after the energizing;

substantially simultaneously changing a load on the engine and switching to open valve injection, after the injecting fuel using closed valve injection.

7. The method of claim 6, further comprising:

de-energizing the internal heater after the energizing and after catalyst light-off.

8. The method of claim 7, wherein the injecting fuel using closed valve injection occurs substantially simultaneously with the de-energizing.

9. The method of claim 6, further comprising:

switching from the open valve injection to closed valve injection substantially simultaneously with catalyst light-off.

10. The method of claim 6, wherein the providing includes providing an internal combustion engine having a plurality of fuel injectors, each of the plurality of fuel injectors including an internal heater.

11. A method of heating fuel using a heated tip fuel injector comprising:

providing an internal combustion engine having at least one fuel injector, the at least one fuel injector having an internal heater;

energizing the internal heater; and then starting the engine;

injecting fuel using closed valve injection after the starting; and substantially simultaneously changing a load on the engine and switching to open valve injection, after the injecting fuel using closed valve injection.

12. The method of claim 11, further comprising: de-energizing the internal heater after the starting and after catalyst light-off.

13. The method of claim 12, wherein the injecting fuel used closed valve injection occurs substantially simultaneously with the de-energizing.

14. The method of claim 11, further comprising:

switching from the open valve injection to closed valve injection substantially simultaneously with catalyst light-off.

15. The method of claim 11, wherein the providing includes providing an internal combustion engine having a plurality of fuel injectors, each of the plurality of fuel injectors including an internal heater.

* * * * *